US005140370A

United States Patent [19]

Kasai et al.

[11] Patent Number: 5,140,370

[45] Date of Patent: Aug. 18, 1992

[54] IMAGE FORMING APPARATUS FOR FORMING A MASTER COPY

[75] Inventors: Toshihiro Kasai; Shigeru Fujiwara; Tatsuya Tsujii, all of Yokohama, Japan

[73] Assignee: Kabushiki Kaisha Toshiba, Kawasaki, Japan

[21] Appl. No.: 493,292

[22] Filed: Mar. 14, 1990

[30] Foreign Application Priority Data

Mar. 16, 1989 [JP] Japan ..... 1-64340

[51] Int. Cl.[5] ..... G03G 15/00

[52] U.S. Cl. ..... 355/210; 355/213; 355/272; 346/74.2

[58] Field of Search ..... 355/210, 213, 272, 77, 355/251; 346/74.2, 74.5; 430/39, 122

[56] References Cited

U.S. PATENT DOCUMENTS

| | | | |
|---|---|---|---|
| 3,615,128 | 10/1971 | Bhagat . | |
| 3,795,442 | 3/1974 | Kimura et al. . | |
| 3,993,484 | 11/1976 | Rait et al. | 346/74.2 X |
| 4,035,810 | 7/1977 | Blossey et al. | 346/74.2 X |
| 4,072,957 | 2/1978 | Kokaji et al. | 346/74.2 |
| 4,084,899 | 4/1978 | Ishida et al. . | |
| 4,101,320 | 7/1978 | Sellers et al. | 346/74.2 X |
| 4,273,438 | 6/1981 | Nishikawa . | |
| 4,343,008 | 8/1982 | Swigert | 430/39 X |
| 4,352,549 | 10/1982 | Ozawa . | |
| 4,407,918 | 10/1983 | Sato | 430/54 |
| 4,669,861 | 6/1987 | Nukushina et al. . | |

*Primary Examiner*—R. L. Moses
*Attorney, Agent, or Firm*—Foley & Lardner

[57] ABSTRACT

An image forming apparatus having a static latent image forming unit for forming a static latent image corresponding to an original image on an image carrying member, a first developing unit for developing the static latent image, formed by the static latent image forming unit, by a first magnetic developing agent containing a magnetizable magnetic material, so as to form a first developing agent image, a fixing unit for fixing the first developing agent image, formed by the first developing unit, on the image carrying member, a magnetizing unit for magnetizing the first developing agent image fixed by the fixing unit, so as to form a magnetic latent image, a second developing unit for developing the magnetic latent image by a second magnetic developing agent whose magnetic material content is lower than that of the first magnetic developing agent, so as to form forming a second developing agent image, and a transferring unit for transferring the second developing agent image to a recording medium.

11 Claims, 5 Drawing Sheets

IMAGE FORMING APPARATUS FOR FORMING A MASTER COPY

BACKGROUND OF THE INVENTION

1. Field of the Invention

The present invention relates to an image forming apparatus adapted for use as an electrophotographing apparatus, such as a copying machine, printer, etc.

2. Description of the Related Art

Conventionally, electronic copying machines and printing machines are known as apparatuses for copying the original. In general, the electronic copying machines are easy to operate, requiring only simple arrangements for the copying operation. In printing machines, on the other hand, a negative plate is prepared from the original, and the original image can be repeatedly transferred to recording sheets. Once the negative plate is obtained, therefore, the printing operation can be performed at high speed. The more copies taken of the same original, therefore, the lower the printing costs will be.

In conventional printing machines, however, the cost of the negative plate constitutes a large proportion of the total printing cost, unless about 1,000 or more copies are taken of the same original. Thus, the printing cost is higher than in the case of electronic copying machines. Since the preparation of the negative plate requires an additional process, printing work takes more time and labor. In contrast, the electronic copying machines must repeat processes for charging a photoreceptor drum, exposing the drum surface to an optical image of the original, developing a latent image, and discharging the drum, in taking each copy of one original. Even if the number of copies taken of the same original is increased, therefore, the cost for each copy cannot be lowered. Moreover, the copying speed is much lower than the printing speed of the printing machines.

To cope with these problems, improved electronic copying machines have been put to practical use. According to these copying machines, the copying speed is made substantially as high as the printing speed without changing the existing technological concept. Also, these novel machines do not require any such delicate operations or arrangements as printing machines require.

If the copying speed is further increased, however, very high electric power is required for the exposure of the optical image of the original and the fixation or charging of the developing agent. Accordingly, a regular commercial power supply (100V, 15A) cannot be utilized, and the developing speed must be made unduly high, at the sacrifice of the image quality.

Methods to solve these problems are disclosed in Japanese Patent Application Nos. 63-29273 and 63-29274, for example. In these methods, a first toner image corresponding to an original image is formed on a photoreceptor by the electrophotographing process, with use of a first magnetic toner, and the toner image is fixed on the photoreceptor. The fixed toner image is magnetized to form a magnetic latent image, which is used thereafter as a master image for magnetic printing. The magnetic latent image is developed by means of a second magnetic toner, and finally, a resulting second toner image is transferred to a recording medium. Once the magnetic latent image as the master image is formed, according to these methods, a large number of copies can be obtained at high speed by repeating the development by means of the second magnetic toner and the transfer of the toner image to the recording medium.

In apparatuses using the magnetic printing system described above, the magnetic toner conventionally used is of low coercivity, having the magnetic material content of 5 to 30% by weight. In general, however, the magnetic toner of this type cannot provide a sufficient magnetizing force, so that the residual magnetizing force of the master image for magnetic printing, using such a magnetic toner, is small. Thus, satisfactory magnetic printing cannot be effected, and the density of the resulting copy images is very low.

SUMMARY OF THE INVENTION

An object of the present invention is to provide an image forming apparatus capable of producing copy images of good density.

According to the present invention, there is provided an image forming apparatus which comprises: static latent image forming means for forming a static latent image corresponding to an original image on an image carrying member; first developing means for developing the static latent image, formed by means of the static latent image, by means of a first magnetic developing agent containing a magnetizable magnetic material, thereby forming a first developing agent image; fixing means for fixing the first developing agent image, formed by means of the first developing means, on the image carrying member; magnetizing means for magnetizing the first developing agent image fixed by means of the fixing means, thereby forming a magnetic latent image; second developing means for developing the magnetic latent image by means of a second magnetic developing agent whose magnetic material content is lower than that of the first magnetic developing agent, thereby forming a second developing agent image; and transferring means for transferring the second developing agent image to a recording medium.

In the image forming apparatus according to the present invention, the magnetic material content of the first magnetic developing agent, used to form the magnetic latent image, is higher than that of a magnetic developing agent used for a conventional electrophotographing process. Thus, the residual magnetizing force of the magnetic latent image can be fully increased, so that copy images of good density can be obtained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENT

A preferred embodiment of the present invention will not be described in detail with reference to the accompanying drawings.

Figure 1:
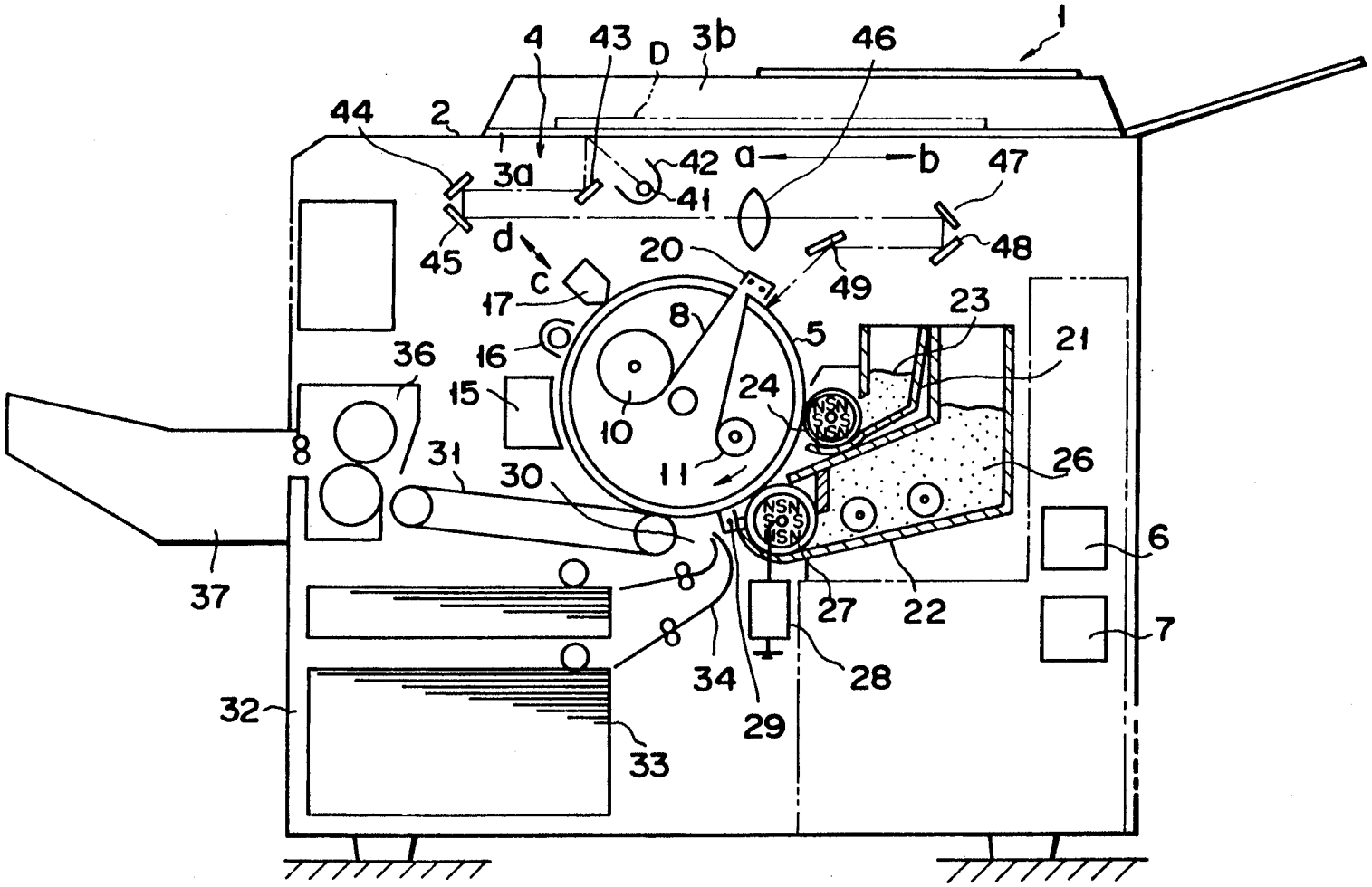
FIG. 1 is a sectional view of an image forming apparatus according to one embodiment of the present invention.

Image forming apparatus 1 shown in FIG. 1 comprises housing 2, original table 3 mounted on the top portion of housing 2, a swingable original holder (not shown), and optical system 4, which applies light to original D on table 3 and guides reflected light from the original to a photoreceptor.

Optical system 4 is constructed as follows. A light source 41 illuminates original D. Light source 41 is backed by cover 42, whereby light from the light source is cut off from the region behind it. The reflected light from original D irradiated by light source 41 is reflected by mirrors 43, 44 and 45, to be guided to lens 46. The reflected light condensed by lens 46 is further reflected by mirrors 47, 48 and 49, to be focused on drum 5. Light source 41 and mirror 43 can be moved together in the directions of arrows a and b of FIG. 1 at a predetermined speed, by means of a drive mechanism (not shown), whereby the whole surface of original D can be scanned. As light source 41 and mirror 43 move in this manner, mirrors 44 and 45 can move following them at half the moving speed of members 41 and 43, in order to maintain a fixed length of the optical path of the reflected light which extends from original D to drum 5.

Drum 5, which is disposed in housing 2, can be rotated in the direction of the arrow of FIG. 1 at least at first and second speeds V1 and V2, by means of a drive mechanism (not shown). In response to a control signal from control unit 6, a speed of 10 to 50 mm/sec and a speed of 200 mm/sec or more are selected, for the drive, as first and second speeds V1 and V2, respectively, of the peripheral surface of drum 5.

Photoreceptor belt 8, for use as an image carrying member, is wound once around drum 5. As shown in FIGS. 2 to 9, belt 8 is formed of a dielectric on which a static latent image can be formed, and has photoreceptor layer 9 of zinc oxide which is long-wave-sensitized by means of a pigment, such as rose Bengal, for sensitivity to a visible spectrum. Belt 8 is paid out from supply roll 10 onto drum 5 for a predetermined size every time original D for printing is changed, and the used portion of belt 8 is wound up on take-up roll 11.

Drum 5 is surrounded by corona charger 20, first developing unit 21, second developing unit 22, pre-transfer corona charger 29, sheet feeding section 30, fixing unit 15, discharge lamp 16, and magnetic head 17, which are successively arranged in the rotating direction of drum 5 or in the direction of the arrow of FIG. 1.

Corona charger 20, which is opposed to drum 5, uniformly charges photoreceptor belt 8 on drum 5, rotating at first speed V1, to −300 to −600 V.

First developing unit 21, which uses the so-called conductive one-component developing system, contains first magnetic developing agent 23 for use as a carrierless toner. Preferably, developing agent 23 includes magnetic materials whose residual magnetism and coercivity are higher than those of conventional magnetic materials. Suitable magnetic materials include powdered barium ferrite, $\gamma$-$Fe_2O_3$, $Fe_3O_4$, Co-$\gamma$-$Fe_2O_3$, $CrO_2$, Fe (iron powder), etc., which have satisfactory magnetic properties. The magnetic material must be easily permanently magnetized in a magnetic field generated by magnetic head 17, mentioned later. Therefore, other magnetic materials with high magnetic properties may be also used for the purpose. First magnetic developing agent 23 can be obtained by mixing 20 to 80% by weight of the magnetic material with a binding resin to produce particles with an average size of 1 to 30 $\mu$m.

The higher the magnetic material content of first magnetic developing agent 23, the higher the residual magnetization rate will be. Since developing agent 23 must be fixed on photoreceptor layer 9 by flashing, however, it requires some resin component. Thereupon, the inventors hereof produced magnetic toners of various magnetic material contents, and examined their susceptibility to flash-fixing. As a result, it was indicated that relatively high fixing capability can be obtained with use of the magnetic material content of about 80% or less, as mentioned in detail later.

First magnetic developing agent 23 is transported to the side of photoreceptor belt 8 as magnet sleeve 24 rotates. Depending on the potential of the static latent image on belt 8, an electric charge is induced in developing agent 23, that is, developing agent 23 is charged.

Second developing unit 22 contains second magnetic developing agent 26. Preferably, developing agent 26 is a magnetic on component toner (magnetic toner) which contains magnetic material powder, such as $Fe_3O_4$, whose electric resistance is as high as $1\times10^9$ $\Omega\cdot$ cm or more and whose residual magnetism is low. Second magnetic developing agent 26 can be obtained by mixing 20 to 80% by weight of the magnetic material with a binding resin. Preferably, developing agent 26 has an average particle size of 1 to 30 $\mu$m.

Second magnetic developing agent 26 is transported to the side of photoreceptor belt 8 as magnet sleeve 27 rotates. A developing bias of 100 to 200 V is applied to sleeve 27 by means of bias voltage generator 28. As the developing bias is applied in this manner, second developing agent 26 is prevented from electrostatically adhering to regions outside a magnetic latent image, during the development of the latent image (mentioned later). The developing bias is adjusted to the polarity opposite to the charging polarity of second magnetic developing agent 26.

Pre-transfer corona charger 29 uniformly charges second magnetic developing agent 26 which adheres to first magnetic developing agent 23. The charging polarity of charger 29 is negative, in order that electric charge remaining on photoreceptor layer 9 can be removed by application of light (de-electrifying light).

Sheet feeding section 30 delivers recording sheets 33 for use as recording media, stacked in layers in recording sheet holding unit 32, to the region between transfer belt 31 and photoreceptor belt 8 via guide 34, in synchronism with transfer operation.

Transfer belt 31 comprises a belt body of conductive material and dielectric film of polyester or the like, having a thickness of about 20 to 40 μm, formed on surface of the belt body. A bias voltage of about 1,500 V, opposite in polarity to a charge of a pre-transfer corona produced by pre-transfer corona charger 29, is applied to belt 31. Fixing unit 36 of the conventional heat-roller type and receiving tray 37 are arranged on the feed-end side of transfer belt 31. Instead of applying the bias voltage to belt 31, recording sheet 33 may be charged by means of corona discharge.

Fixing unit 15 fixes a developing agent image, visualized by first developing unit 21, to photoreceptor belt 8 by the flash fixation method using a xenon lamp, thereby forming a magnetic image as a master image.

Discharge lamp 16 is used to remove electric charge remaining on photoreceptor layer 9 of photoreceptor belt 8 charged by corona charger 20 or pre-transfer corona charger 29.

Figure 10:
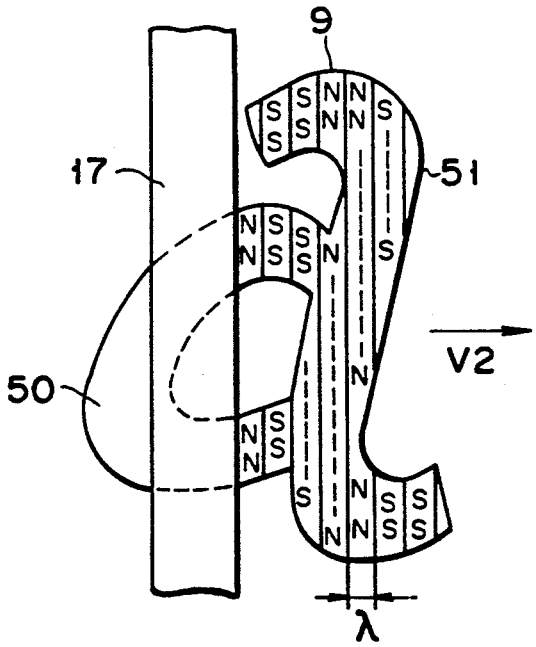
FIG. 10 shows the way a developing agent image is magnetized by means of a magnetic head.

Magnetic head 17 is formed, for example, of a single-track head having a length equivalent to the full width of photoreceptor belt 8. Head 17 is movable in the directions of arrows c and d. In a process for forming the master image mentioned later, head 17 is moved in the direction of arrow c to approach photoreceptor belt 8, in response to a control signal from control unit 6. In a printing process, head 17 is moved in the direction of arrow d to move away from belt 8, and then stand by. In the master image forming process, an ac voltage of a predetermined frequency from power source 7 is applied with magnetic head 17 located close to photoreceptor belt 8, so that the direction of the magnetic field is periodically changed to form an ac magnetic field in the vicinity of the closely opposed surfaces. Due to this ac magnetic field, a magnetic latent image is formed such that south and north poles are alternately arranged by two rows each having width λ, as shown in FIG. 10. Thus, master image 51 for magnetic printing is formed.

In the printing process, magnetic head 17 is in a stand-by position distant from photoreceptor belt 8, so that it is prevented from approaching and influencing master image 51.

Frequency f of the ac voltage from power source 7 applied to magnetic head 17 is an essential factor to determine the recording wavelength (distance between south and north poles) of a residual magnetism pattern. This recording wavelength depends on the moving speed of the medium and frequency f of the ac voltage. The inventors conducted tests based on various combinations of the moving speed of the medium and frequency f of the ac voltage. Thereupon, it was indicated that satisfactory copy images can be obtained even for fine lines and solid pictures if the recording wavelength ranges from 20 to 80 μm.

Figure 11:
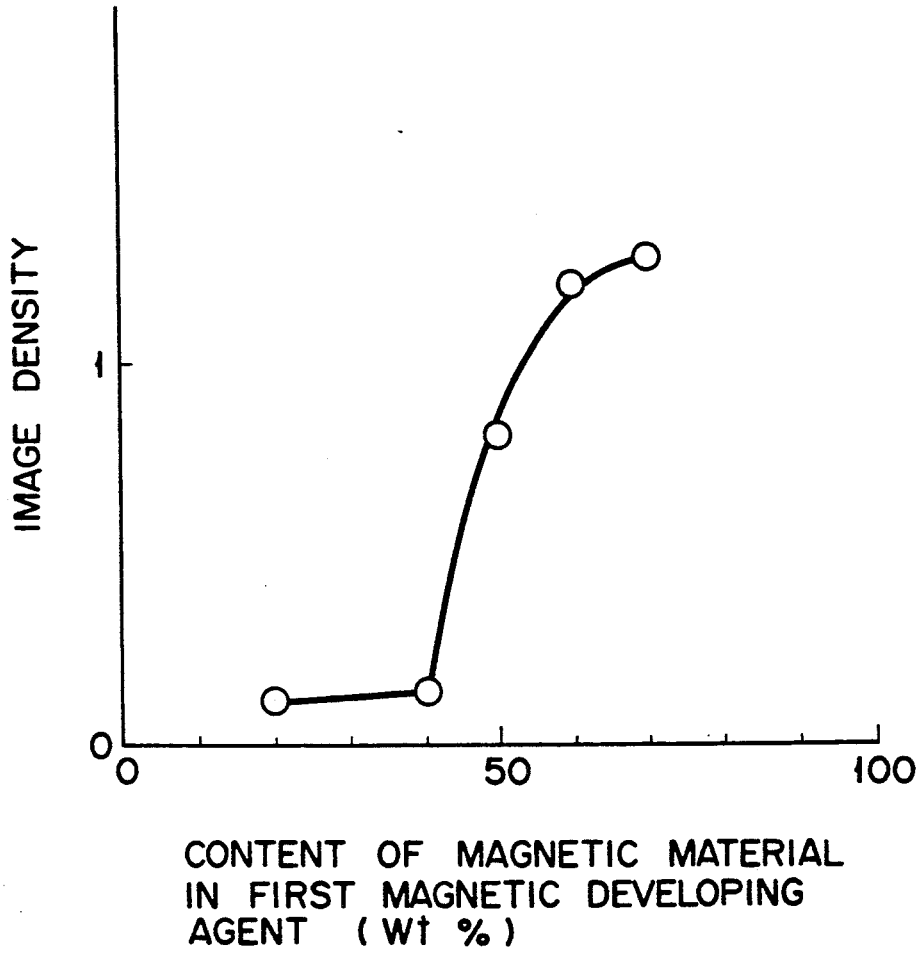
FIG. 11 is a graph showing the relationship between the magnetic material content (% by weight) of a first magnetic developing agent and the density of a copy image obtained by means of a second magnetic developing agent.

FIG. 11 is a graph showing the relationship between the magnetic material content (% by weight) of the first magnetic developing agent and the density of the copy image obtained by means of the second magnetic developing agent. The second developing agent used includes 20% of magnetic material by weight. As seen from the graph of FIG. 11, copy images of good density can be obtained when the magnetic material content of the first developing agent ranges from 40 to 80% by weight.

Referring now to FIGS. 2 to 9, the operation of the image forming apparatus 1 with the aforementioned construction will be described. Apparatus 1 can be operated in two modes, a print mode for a relatively large number of copies from the same original and a copy mode for a relatively small number of copies. The print mode will be described first.

Figure 2:
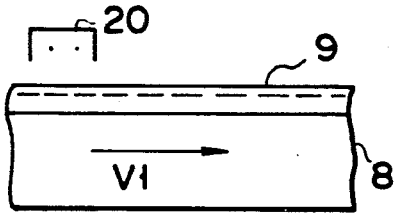
FIGS. 2 to 9 are sectional views successively showing image forming processes in a print mode of the image forming apparatus of the invention.

The print mode is first assigned operating an operating section (not shown). Optical system 4 then starts to read original D. Thereupon, drum 5 and photoreceptor belt 8 rotate together in the direction of the arrow at first speed V1, in response to a control signal from control unit 6. Meanwhile, photoreceptor layer 9 of belt 8, wound around drum 5, is uniformly negatively charged by corona charger 20, as shown in FIG. 2. At the same time, magnetic head 17 moves in the direction of arrow c of FIG. 1, thereby approaching photoreceptor belt 8 to be magnetized.

Figure 3:
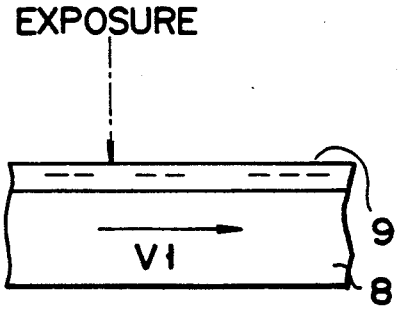

In this state, the reflected light from original D, irradiated by light source 41, is guided to optical system 4 and focused on photoreceptor belt 8 around drum 5. As a result, the electric charge on the irradiated portions disappears, as shown in FIG. 3. By successively repeating these processes to operation, a static latent image corresponding to the original image can be formed on photoreceptor layer 9.

Figure 4:
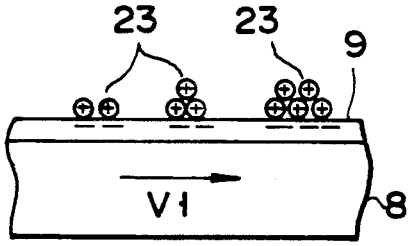

The static latent image obtained in this manner is developed as it passes through first developing unit 21 by means of the first magnetic developing agent whose magnetic material content is higher than that of the second magnetic developing agent, more specifically, as shown in FIG. 4, a positive electric charge is induced from a developing sleeve by the static latent image, and positively charged first developing agent 23 electrostatically adheres to the negatively charged portions of photoreceptor layer 9. Thus, a developing agent image (first magnetic toner image) corresponding to the picture is formed.

Figure 5:
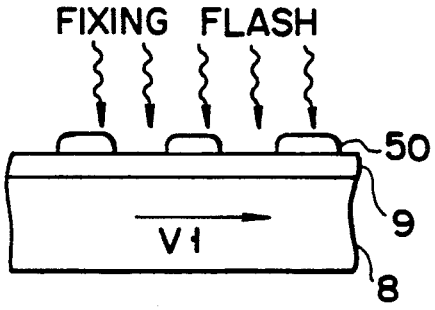

Subsequently, photoreceptor belt 8 is rotated at first speed V1 so that the developing agent image reaches fixing unit 15, and thermic rays are applied by means of the xenon lamp, whereupon the image is instantaneously fused to photoreceptor layer 9 of belt 8, as shown in FIG. 5. Magnetic pattern image 50, fixed by a fixing flash in this manner, is cleared of residual magnetism by means of discharge lamp 16, and is further rotated to the region facing magnetic head 17. It is advisable to keep lamp 16 on during the subsequent processes of operation, in order to prevent photoreceptor layer 9 from being charged.

Figure 6:
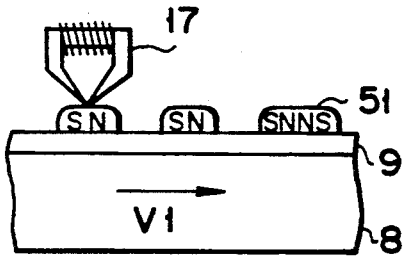

Thus moved to the region corresponding to magnetic head 17, magnetic pattern image 50 is permanently magnetized, as shown in FIG. 6, as it passes through ac magnetism formed when the ac voltage of frequency f, within a range such that the recording wavelength ranges from 20 to 80 μm, is applied to head 17. FIG. 10 shows the polar arrangement of a residual magnetism pattern formed on pattern image 50 during the permanent magnetization.

As drum 5 makes one revolution in this manner, magnetic pattern image 50 is magnetized so that master image 51, i.e., a magnetism pattern as a magnetic latent image, is formed, whereupon the master image forming process ends. During the permanent magnetization by means of magnetic head 17, photoreceptor belt 8, which is formed of a nonmagnetic material, cannot be magnetized, and only master image 51 is magnetized.

Drum 5 continues to thereafter. After the first revolution, it rotates at high speed, that is, at second speed V2, in response to a control signal from control unit 6. During this high-speed rotation, the image is developed by means of the second developing unit, and the developed image is transferred to recording sheet 33. In the meantime, magnetic head 17 is moved in the direction of arrow d of FIG. 1, to be situated in the stand-by position distant from drum 5.

Figure 7:
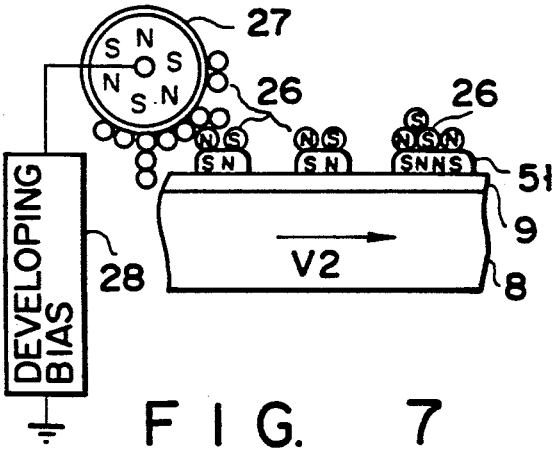

When master image 51, magnetized in the aforementioned master image forming process, is moved to the region facing second developing unit 22, second magnetic developing agent 26 is attracted to the master image by the magnetic force thereof, and adheres to the surface of the master image, as shown in FIG. 7. Thus, a developing agent image (second magnetic toner image) is formed using second developing agent 26.

In this case, second magnetic developing agent 26 is attracted by the sufficient magnetic force of master image 51 formed by means of first magnetic developing agent 23, whose magnetic material content is higher than the magnetic toner used in a conventional electrophotographing process, e.g., second developing agent 26. By using this second developing agent, therefore, a second magnetic developing agent image can be formed which ensures a satisfactory density for the copy image as a final image.

Since second magnetic developing agent 26 is attracted to master image 51 by the magnetic force, it need not be charged during the developing operation. In a transfer process mentioned later, however, pre-transfer corona discharge is effected to charge the image for electrostatic transfer. For this charging process, the second magnetic developing agent must have an electric insulating property. Naturally, therefore, second developing agent 26 has frictional chargeability. Thus, in a process for magnetically developing master image 51, developing agent 26 inevitably electrostatically adheres also to photoreceptor belt 8, although it is expected to adhere only to the magnetic latent image.

In the image forming apparatus according to the present invention, bias voltage generator 28 applies an electrical developing bias to magnet sleeve 27 of the second developing unit. By doing this, second magnetic developing agent 26 can be prevented from electrostatically adhering to those portions of photoreceptor belt 8 which carry no magnetic latent image. In this case, a negative bias voltage is applied if the charging polarity of developing agent 26 is positive, and a positive bias voltage is applied if the charging polarity is negative.

The magnetic force of magnet sleeve 27 of the second developing unit is adjusted so as to be balanced, as required, with that of magnetized master image 51. If the magnetic force of sleeve 27, used to transport second magnetic developing agent 26 toward master image 51, is too great, the developing efficiency is so low that a distinct image cannot be obtained. If an external magnetic field of an intensity higher than the coercivity of first magnetic developing agent 23 is formed by means of magnet sleeve 27, the magnetism pattern of master image 51 disappears. If the magnetic force of sleeve 27 is too small, on the other hand, second magnetic developing agent 26 cannot be successfully transported, and a distinct image cannot be obtained. In consideration of these circumstances, the magnetic force of magnet sleeve 27 is adjusted to balance the two magnetic forces.

Figure 8:
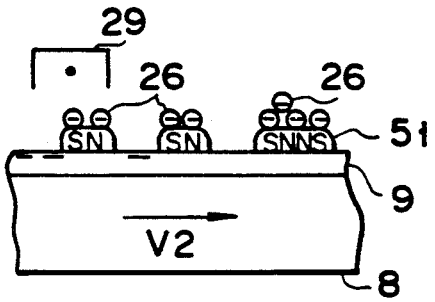

The second magnetic toner image formed in this manner, as shown in FIG. 8, is negatively charged by being subjected to the pre-transfer corona discharge by means of pre-transfer corona charger 29.

Meanwhile, each recording sheet 33 fed from sheet feeding section 30 is transported in the rotating direction of drum 5 in synchronism with the rotation thereof by means of transfer belt 31, and is held between photoreceptor belt 8 and belt 31. In this case, a positive bias voltage, which is opposite in polarity to the pre-transfer corona, is applied to transfer belt 31, as shown in FIG. 9, so that second magnetic developing agent 26 is electrostatically transferred to recording sheet 33.

After the transfer, recording sheet 33 is delivered to fixing unit 36 of the heat-roller type as transfer belt 31 runs. The image is fixed to sheet 33 by being heated under pressure by means of fixing unit 36, whereupon the sheet is discharged onto receiving tray 37.

If second magnetic developing agent 26 has satisfactory frictional chargeability, the pre-transfer corona discharge by means of pre-transfer corona charger 29 may be omitted. If quick and secure electrostatic transfer is needed, as in the case of high-speed transfer, however, it is advisable to fully charge developing agent 26 in advance by means of pretransfer corona discharge.

Figure 9:
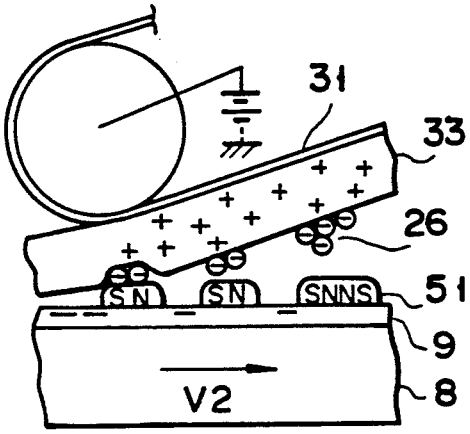

Additional copies of the same contents can be taken of the same original by repeating the second magnetic toner forming process (FIG. 7), pre-transfer corona discharge process (FIG. 8), and transfer process (FIG. 9). Thus, once master image 51 is formed and magnetized, it is unnecessary to repeat any of the charging process (FIG. 2), exposure process (FIG. 3), first magnetic toner image forming process FIG. 4), fixing process (FIG. 5), or magnetization process (FIG. 6). Accordingly, copying speed is increased, and the electric power required for the charging and exposure can be appropriated for the drive of fixing unit 36, thus ensuring economy of power.

When the taking a plurality of copies of one original is finished, photoreceptor belt 8 is wound up on take-up roll 11 for the size of the region on which master image 51 is fixed, and an unused portion of the belt is fed onto drum 5.

The following is a description of the copy mode which is suited for a small number of copies. The copy mode differs from the print mode in that master image 51 is not formed. In the copy mode, drum 5 is rotated at first speed V1 or at third speed V3 which is higher than speed V1. Speed V3 is lower than speed V2 for the printing process in the print mode.

The copy mode is first assigned by operating the operating section (not shown). Optical system 4 shown in FIG. 1 then starts to read original D. Thereupon, drum 5 and photoreceptor belt 8 rotate together in the direction of the arrow at first speed V1 (or third speed), and photoreceptor layer 9 of belt 8 is uniformly charged by corona charger 20, as shown in FIG. 2. Even if the rotating speed of drum 5 is lower than speed V1, the voltage of corona charger 20 and the like can be adjusted, depending on the drum speed, in order to obtain a predetermined potential.

An image obtained by means of optical system 4 is focused on photoreceptor layer 9, as shown in FIG. 3, thereby forming a static latent image. The static latent image obtained in this manner is visualized by means of the second developing unit, as shown in FIG. 11. In the copy mode, no magnetic force can be utilized for developing, so that a developing agent image corresponding to the original image is obtained by causing second magnetic developing agent 26, positively charged by friction-charging, for example, to adhere electrostatically to the negative electric charge on photoreceptor layer 9.

Figure 12:
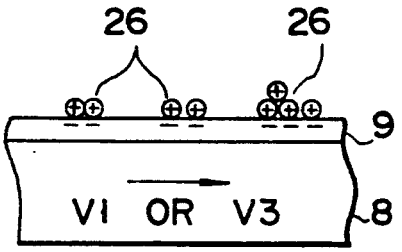
FIGS. 12 to 15 are sectional views successively showing image forming processes in a copy mode of the image forming apparatus of the invention.
Figure 13:
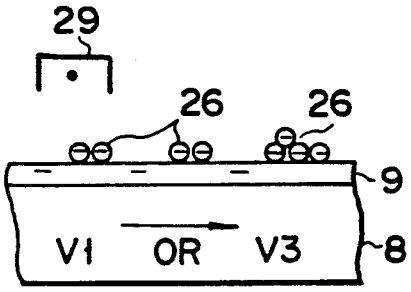

Drum 5 continues to be rotated, and is subjected to corona discharge by pre-transfer corona charger 29, to be charged thereby, as shown in FIG. 12. Thereafter, second magnetic developing agent 2 is transferred to recording sheet 33. After the transfer, the image is fixed to sheet 33 in the same manner as in the print mode, by means of fixing unit 36 of the heat-roller type, whereupon the sheet is discharged onto receiving tray 37.

Figure 14:
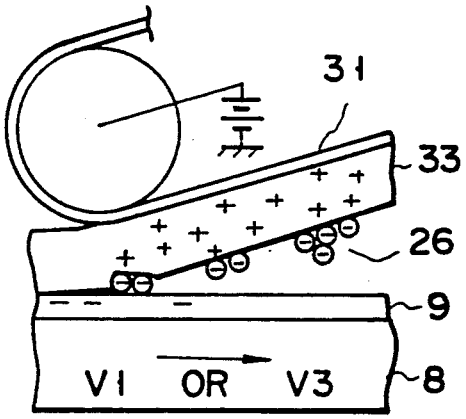
Figure 15:
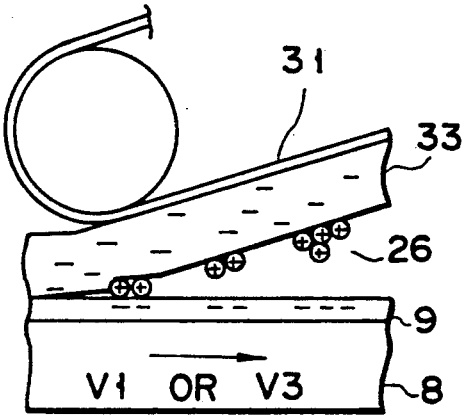

A voltage of a polarity may be applied to transfer belt 31 such that recording sheet 33 is negatively charged, as shown in FIG. 14, or second magnetic developing agent 26 may be transferred to sheet 33 without undergoing the corona discharge (FIG. 12).

Meanwhile, those particles of second magnetic developing agent 26 which remain on photoreceptor layer 9 after the transfer are de-electrified by means of discharge lamp 16, and then collected in the second developing unit, while drum 5 makes another revolution. Thus, in the image forming apparatus 1 of the present invention, drum 5 makes two revolutions for each copy, that is, photoreceptor layer 9 is cleaned while drum 5 makes the first revolution. In this copy mode, the same surface region of photoreceptor belt 8 may be used about 1,000 times, for example. When a predetermined number of uses has been attained, belt 8 is wound up on take-up roll 11 for a predetermined length, and an unused portion of the belt is fed onto drum 5 for another cycle of operation.

In the image forming apparatus according to the present invention, as described above, the master image is formed by means of the first magnetic developing agent whose magnetic material content is higher than the magnetic toner used for the conventional electrophotographing process, e.g., the second developing agent. Accordingly, the residual magnetizing force of the master can be fully increased to ensure the density of the finally obtained copy image.

Thus, in the image forming apparatus according to the present invention, the static latent image, formed corresponding to the original image on the photoreceptor belt, is developed by means of the first magnetic developing agent of the increased magnetic material content, so that the residual magnetization rate of resulting master image is high. Accordingly, the master image can intensely attract the second magnetic developing agent, thereby ensuring the production of the copy image of good density.

According to the image forming apparatus of the present invention, moreover, the master image forming process may be omitted in taking a second and subsequent copies in the print mode. Accordingly, electric power can be saved, and a printing operation can be performed at high rotating speed V2 after the master image is formed. Thus, the printing speed can be considerably increased. In taking the second and subsequent copies, moreover, the image forming process can be shortened, so that the developing speed need not be unduly high, and therefore, the image quality cannot be lowered.

In the process for developing the master image, furthermore, the second magnetic developing agent is prevented from statically adhering to the no-image portions by applying electrical developing bias, so that a fog-free copy image of high quality can be obtained.

Furthermore, the first magnetic developing agent, which is used to form the master image, has no relation to the actual copy color, so that any colors may be used for the copying. Accordingly, the material of the first develop agent can be easily selected in consideration of its ability to be magnetized.

In the embodiment described above, zinc oxide is used as the material for the photoreceptor bet. However, the present invention is not limited to this embodiment, and the photoreceptor belt may be formed of various other photosensitive materials or dielectric materials for electrostatic recording. In the aforementioned embodiment, moreover, the reflected light from the irradiated original is applied to the image carrying member through the optical system for exposure. Alternatively, however, the photoreceptor layer may be exposed by means of a laser scanner.

Furthermore, the image forming apparatus of the present invention, which may naturally be applied to a copying machine, may be also effectively used, for example, for a laser printer which is adapted to make a great number of copies at a time.

It is to be understood that various changes and modifications may be effected in the present invention by one skilled in the art without departing from the scope or spirit of the invention.

According to the present invention, as described in detail herein, there may be provided an image forming apparatus which can produce a fog-free image of high quality, despite the use of a magnetic toner of the friction-charging type.

Additional advantages and modifications will readily occur to those skilled in the art. Therefore, the invention in its broader aspects is not limited to the specific details, representative devices, and illustrated examples shown and described herein. Accordingly, various modifications may by without departing from the spirit or scope of the general inventive concept as defined by the appended claims and their equivalents.

What is claimed is:

1. An image forming apparatus comprising:

means for forming a static latent image corresponding to an original image on an image carrying member;

first developing means for developing the static latent image, formed by the forming means, by means of a first magnetic developing agent containing a magnetizable magnetic material, so as to form a first developing agent image;

means for fixing the first developing agent image, formed by the first developing means, on the image carrying member;

means for magnetizing the first developing agent image fixed by means of the fixing means, so as to form a magnetic latent image;

second developing means for developing the magnetic latent image by means of a second magnetic developing agent whose magnetic material content is lower than that of the first magnetic developing agent, so as to form a second developing agent image; and means for transferring the second developing agent image from the image carrying member to a recording medium.

2. The image forming apparatus according to claim 1, wherein said first magnetic developing agent contains a binder resin and 40 to 80% by weight of a magnetic material powder.

3. The image forming apparatus recording to claim 2, wherein said magnetic material powder has an average particle size of 1 to 30 μm.

4. The image forming apparatus according to claim 2, wherein said magnetic material powder is formed of one material selected from the group consisting of barium ferrite, T -$Fe_2O$ 3, $Fe_3O_4$, Co-T -$Fe_2O_3$, $CrO2$, and Fe (iron powder).

5. The image forming apparatus according to claim 1, wherein said second magnetic developing agent contains a binder resin and 10 to 40% by weight of a magnetic material powder.

6. The image forming apparatus according to claim 1, wherein said first magnetic developing agent is a conductive one-component magnetic developing agent capable of being permanently magnetized by the magnetizing means.

7. The image forming apparatus according to claim 1, further comprising pre-transfer charging means for charging the second developing agent image.

8. The image forming apparatus according to claim 1, further comprising fixing means for fixing the second developing agent image transferred to the recording medium by the transferring means.

9. The image forming apparatus according to claim 1, wherein said image carrying member is formed of a photoreceptor belt having a photoreceptor layer on the surface thereof and wound around a drum.

10. The image forming apparatus according to claim 9, wherein said drum is rotatable at a first circumferential speed and a second circumferential speed higher than the first speed.

11. The image forming apparatus according to claim 10, wherein said first speed ranges from 10 to 50 mm/sec, and said second speed is 200 mm/sec or more.

* * * * *